United States Patent [19]

Robertson

[11] 4,336,652

[45] Jun. 29, 1982

[54] CUTTING TOOL FOR FLEXIBLE PLASTIC CONDUIT

[76] Inventor: Duane D. Robertson, 105 Flora Way, Golden, Colo. 80401

[21] Appl. No.: 174,727

[22] Filed: Aug. 1, 1980

[51] Int. Cl.[3] ..... B26B 13/00

[52] U.S. Cl. ..... 30/258; 30/92; 30/341

[58] Field of Search ..... 30/90.1, 258, 250, 252, 30/92, 341

[56] References Cited

U.S. PATENT DOCUMENTS 59,168 10/1866 Bender ..... 30/258

2,384,822 9/1945 Drmic ..... 30/250

FOREIGN PATENT DOCUMENTS 21329 4/1883 Fed. Rep. of Germany ..... 30/258

793 of 1878 United Kingdom ..... 30/258

*Primary Examiner*—Stephen G. Kunin

*Assistant Examiner*—J. T. Zatarga

*Attorney, Agent, or Firm*—Ralph F. Crandell

[57] ABSTRACT

A cutting tool for cutting flexible plastic conduit, formed by a pair of handled jaws pivotally connected intermediate their ends. One jaw is box shaped in cross-section and forms a handle which supports a knife blade, which has a longitudinal cutting edge. The other jaw is generally channel-shaped in cross-section and forms a handle with a semi-circular concave anvil at one end. The anvil has an axially extending slot therein for receiving the cutting edge of the knife blade when the handles are closed together with the box-shaped handle nested within the channel-shaped handle. A conduit supported in the semi-circular anvil is cut by the knife blade as the handles are squeezed together.

7 Claims, 18 Drawing Figures

CUTTING TOOL FOR FLEXIBLE PLASTIC CONDUIT

BACKGROUND OF THE INVENTION

1. Field of the Invention

The present invention relates to cutlery and, more specifically, to a cutting tool having a pair of pivoted handles, one of which carries a blade and the other of which defines a semi-circular anvil or cradle for receiving and supporting the article to be cut. More particularly, the present invention relates to an improved cutting tool for cutting flexible plastic pipe or conduit.

2. Description of the Prior Art

Cutting tools for cutting cylindrical objects such as flexible plastic pipe or conduit, are generally known. See, for example, U.S. Pat. Nos. 331,787 to Harlow, 589,101 to Scholes, 717,800 to Bell, 1,524,196 to Mayhew, 4,084,317 to Nakamura et al., 4,092,774 to Watts, and 4,094,064 to Nishikawa et al.

OBJECTS AND SUMMARY OF THE INVENTION

The principal object of the present invention is to provide an improved cutting tool for cutting flexible pipe or conduit.

Another object of the present invention is to provide a cutting tool for flexible pipe or conduit, which is simple, light in weight, strong, rugged, and useful with a wide variety of pipe sizes.

A further object of the present invention is to provide a cutting tool of the foregoing character which is easily grasped and used, which will not pinch the user, and will cleanly and quickly sever the pipe.

Still a further object of the present invention is to provide a cutting tool of the foregoing character which includes a knife which cuts entirely through the conduit without the use of levers, ratchets or other mechanical arrangements to increase the cutting sweep of the knife.

Still another object of the present invention is to provide a cutting tool of the foregoing character in which the knife is fully shielded in the closed position to protect the knife and the user.

Other objects and advantages of the invention will become apparent as the following description proceeds.

In accordance with the foregoing objects, the present invention is embodied in a cutting tool or shears for cutting flexible plastic conduit. The tool is formed by a pair of handled jaws or arms pivotally connected intermediate their ends in a first-class lever or pliers configuration. One of said jaws or arms is generally box-shaped in cross-section, and defines a handle at one end and carries a knife blade at the other end, with the knife blade forming an extension of the arm or handle. The knife blade is provided with a longitudinal, sharp, cutting edge. The box-shaped configuration of the jaw or arm is formed by a channel-shaped body member with the channel opening enclosed by a cap or cover strip. For receiving and holding the knife blade, a slot is provided in one end of the handle and the knife blade is removably pinned in the slot.

The other jaw or arm is generally channel-shaped in cross-section with the channel being of a width sufficient to telescopingly receive the box-shaped arm. At one end, the channel-shaped arm is provided with a semi-circular concave anvil or cradle for receiving and supporting a pipe or conduit to be cut. An axially extending elongated slot is cut in the cradle or anvil surface to receive the knife so that the knife can pass completely through a conduit supported in the cradle. The slot further forms a protective shield when the tool is in the closed position to prevent the knife blade from cutting the user or becoming damaged in a tool box. At its underside, the cradle or jaw portion of the handle is reinforced with parallel ribs which serve to rigidify the tool, and the end of the tool adjacent the cradle is closed by a rounded web.

The handles are pivoted together intermediate their ends to form a first-class or pliers type tool. The handle end of the channel-shaped arm is provided with a recess or notch to facilitate separation of the handles when the tool is in the closed position. The underside of the channel of the channel-shaped arm also includes a boss or stop which gages the extent of closing between the two handles.

The tool is aesthetically designed with a pleasing ornamental configuration, and this aspect of the invention is covered in copending design application Ser. No. 174,726, filed Aug. 1, 1980, for "Design for Cutting Tool for Flexible Plastic Conduit".

The tool is formed of a high impact plastic such as nylon 6 or equivalent molded material. The tool is designed to be readily molded of plastic, although it could equally well be formed of a lightweight castible metal.

DESCRIPTION OF THE PREFERRED EMBODIMENT

Figure 5:
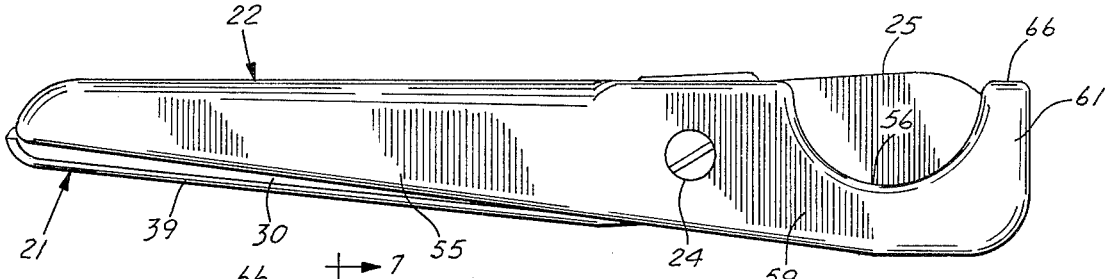
FIG. 5 is a side elevational view of the tool shown in FIG. 1 with the tool in the closed position.
Figure 6:
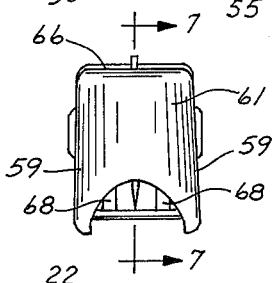
FIG. 6 is an end view of the tool shown in FIG. 5.
Figure 7:
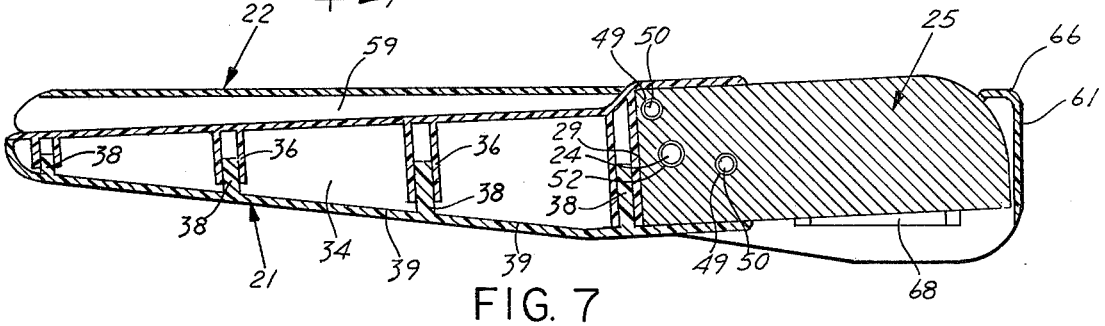
FIG. 7 is a section view taken substantially in the plane of line 7—7 on FIG. 6.
Figure 8:
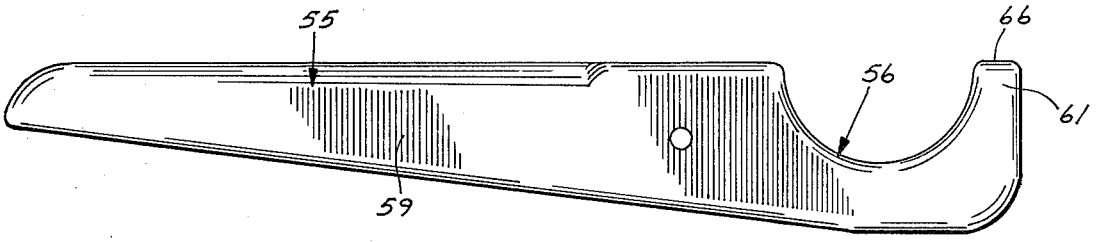
FIG. 8 is a side elevational view of the arm of the tool forming a handle and anvil or cradle, the opposite side being a mirror image of the side shown.
Figure 9:
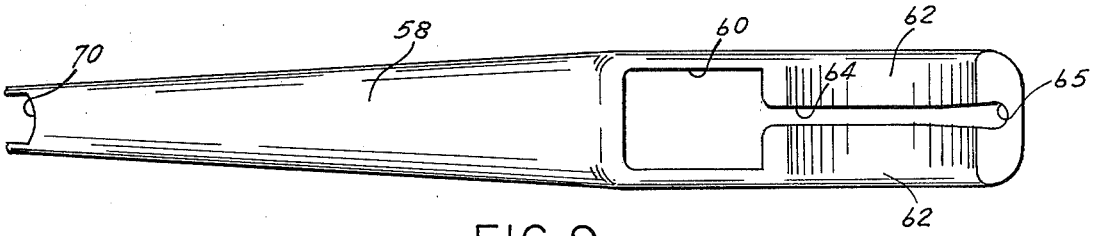
FIG. 9 is a top plan view of the tool portion shown in FIG. 8.
Figure 10:
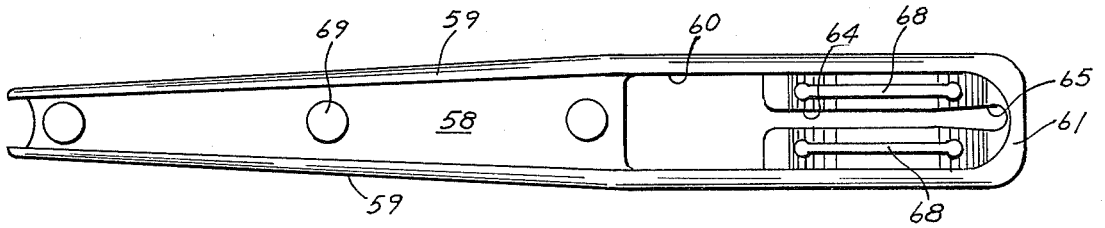
FIG. 10 is a bottom plan view of the tool portion shown in FIG. 8.
Figure 11:
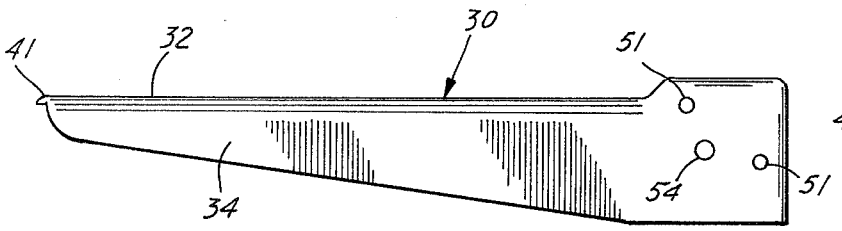
FIG. 11 is a side elevational view of the tool handle portion supporting a knife blade.
Figure 13:
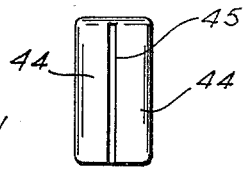
FIG. 13 is an end view of the tool handle portion shown in FIG. 11.
Figure 12:
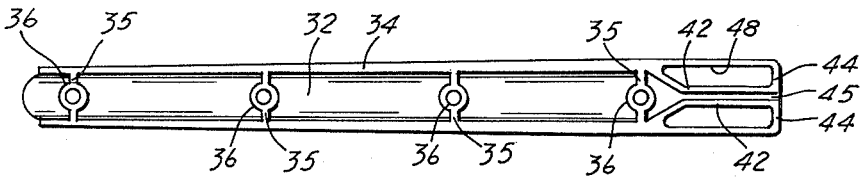
FIG. 12 is a bottom plan view of the tool handle portion shown in FIG. 11, but with the cover strip removed.
Figure 14:
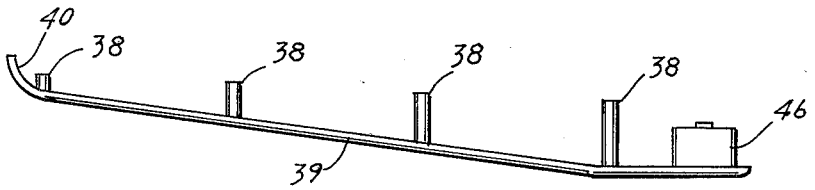
FIG. 14 is an elevational view of the cover strip utilized to form a box configuration with the handle portion shown in FIG. 12.
Figure 15:
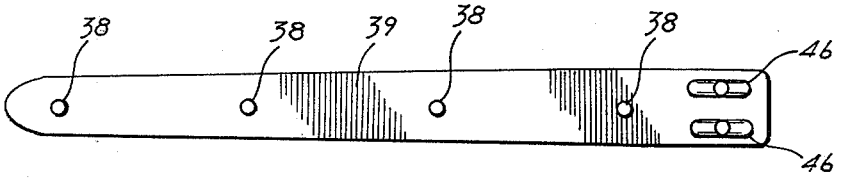
FIG. 15 is a top plan view of the cover plate shown in FIG. 14.
Figure 16:
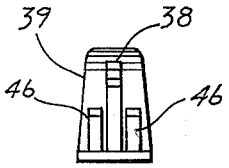
FIG. 16 is an end elevational view of the cover plate shown in FIG. 14.
Figure 17:
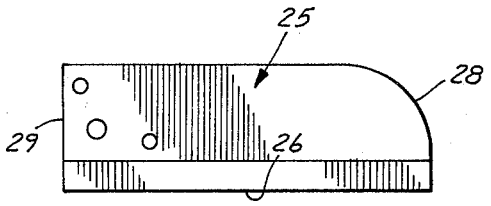
FIG. 17 is a side elevational view of a knife blade.
Figure 18:
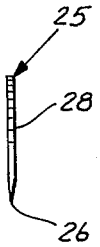
FIG. 18 is an end elevational view of the knife blade shown in FIG. 17.

The present invention is embodied in a cutting tool or shears finding particular, but not necessarily exclusive utility for cutting flexible plastic pipe or conduit such as conventional polyvinyl or polyethylene conduit for water lines. The tool is adapted for cutting a variety of diameters of pipe, ranging generally from one-half inch, to one and one-quarter inch ID pipe. The tool 20, as shown in the drawings, comprises a pair of elongated handled jaws 21, 22, pivoted together intermediate their ends, on a removable pivot pin 24, to form a pliers or first-class lever type tool. As will be described in more detail below, the handled jaws 21, 22 nest together in the closed position, as shown in FIG. 5, in order that the tubing or conduit may be cleanly and completely cut.

One of the handled jaws 21 mounts, at one end thereof, a longitudinally extending knife blade 25 having a sharpened edge 26 and a blunt or rounded nose end 28. At its heel 29 the blade is mounted in a generally box shaped handle 30. The box shaped handle is formed by a three-walled member which is channel-shaped in cross-section, having an upper panel 32 and spaced depending side walls 34 joined by spaced webs 35 defining sockets 36 adapted to receive pins 38 on a cover plate 39 which spans the depending walls 34 and encloses the channel to form a box shaped handle configuration. At its tail end, the cover plate 39 defines a curved lip 40 adapted to extend around the rear ends of the walls 34 and abut an overhanging lip 41 on the channel-shaped handle 30.

For supporting the knife blade 25, the channel-shaped handle section 30 is formed at one end with a pair of spaced internal panels 42 and end walls 44 defining a central axial blade receiving slot 45. For increasing the rigidity of the blade mounting, the cover plate 39 includes a pair of spaced upstanding bosses or ribs 46 adapted to be snugly received within sockets or apertures 48 defined by the exterior walls 34, said interior panels 42 and the end walls 44 of the channel shaped handle portion. When inserted into the handle, the blade is secured in place by roll pins 49, extending through aligned apertures 50 in the blade and corresponding apertures 51 in the side walls 34 of the handle. For purposes of receiving and retaining the pivot pin 24, the blade 25 is provided at its heel end 29 with an appropriate aperture 52 in alignment with a pin receiving aperture 54 in each handle side wall 34.

When the blade and handle parts are assembled, there is provided a handled knife jaw having a handle section 31 at one end and a knife blade 25 at the other, with the knife axially aligned with the handle and having a downwardly directed sharp cutting edge 26. The knife blade is readily replaceable in the handled jaw 21 by removing the pivot pin 24 and separating the jaws 21, 22. The roll pins 49 are then knocked out and the old blade 25 removed. A new blade is inserted, the roll pins 49 are reinserted in the aligned apertures 50, 51, and the handled jaws 21, 22 are reassembled with the pivot pin 24.

Figure 1:
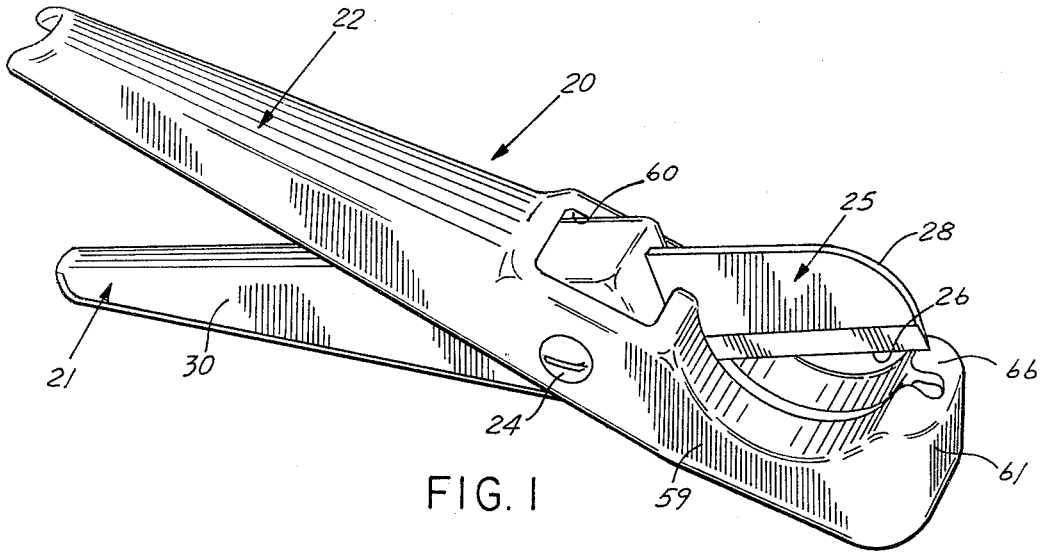
FIG. 1 is a perspective view of a cutting tool embodying the present invention.
Figure 2:
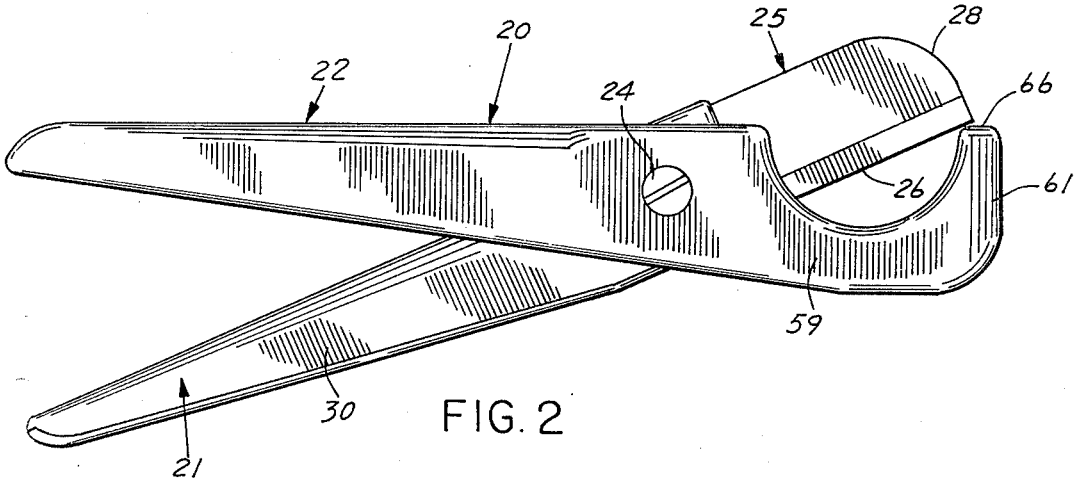
FIG. 2 is a side elevational view of the cutting tool shown in FIG. 1, with the cutting tool in a partially opened position, the opposite side being a mirror image of the side shown.
Figure 3:
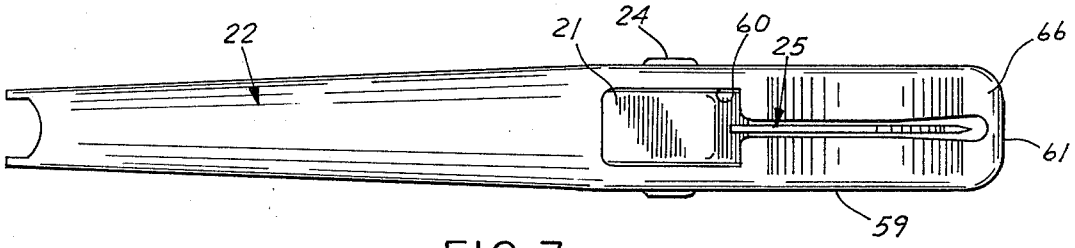
FIG. 3 is a top plan view of the tool shown in FIG. 2.
Figure 4:
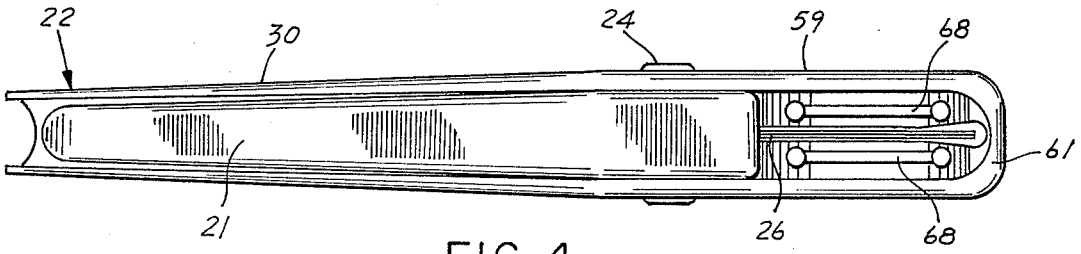
FIG. 4 is a bottom plan view of the tool shown in FIG. 2.

Cooperatively associating with the handled knife jaw 21, to form a cutting tool, the second handled jaw 22 is an elongated member defining at one end a handle section 55 and at its other end a cradle or anvil 56 adapted to receive and support a conduit or pipe to be cut (not shown). The handled cradle jaw 22 or 22 is formed of a generally channel-shaped configuration having an upper wall panel 58 and depending spaced apart side walls 59. A generally rectangular aperture 60 is provided in the upper wall or panel 58 for receiving the blade mounting end of the handled knife jaw 21, when the jaws are pivoted together as shown in FIG. 1.

The cradle or anvil 56 is a generally semi-circular concave wall member extending from the handle 55 to an upstanding end wall 61 of the handled jaw 21. The cradle thus defines a semi-circular seat 62 for supporting the conduit or pipe to be cut. To permit the knife blade 25 to pass completely through the conduit to be cut, a knife receiving slot 64 is provided in the semi-circular cradle wall, opening at one end into the handle receiving aperture 60, and at the other end into an enlarged aperture 65 in the upper portion or top wall 66 of the end wall 61. The depending channel walls 59 of the cradle or anvil handled arm 22 are spaced sufficiently to receive therebetween the box shaped handle 30 of the handled knife jaw 21 when the tool is assembled and the knife is fully seated into the cradle slot, as shown in FIG. 5. In this closed configuration, the knife blade 25 is completely sheathed within the cradle jaw 62 and the handles 30, 55 are telescoped together. Further, with this construction, the knife blade can pass completely through a conduit to be cut, and into the anvil or cradle slot 64, thereby insuring complete severence. The enlarged opening 65 in the cradle slot 64 allows for flexing of the knife blade 25 and prevents the forward end edge of the knife blade from nicking or damaging the end of the cradle or anvil handle.

For further rigidifying and strengthening the anvil or cradle portion 62 of the handle 22, the cradle walls 62 are provided on their under or convex surfaces with elongated, longitudinal strengthening ribs 68, integral with the handle material. The underside of the handle top or web 58 further includes a stop boss 69 which engages the top wall 32 of the box handle 31 when the handles are telescoped together in closed position. To facilitate separation of the handles when in the telescoped position, the rearmost end of the handled cradle or anvil jaw 22 is provided with a recess 70 which facilitates finger engagement with the rear end of the box-shaped handled knife jaw 21.

The various surfaces of the handled jaws 21, 22 are smoothly rounded for aesthetic purposes, as shown in copending application for a design patent, Ser. No. 174,726, filed Aug. 1, 1980, as well as to prevent the user from pinching his hand during use of the tool. The tool can be made of many suitable materials, one preferred material being moldable nylon 6.

In use, the tool is assembled as shown in FIG. 1. The conduit to be cut is placed in the cradle or anvil 56 with the cutting line aligned beneath the knife blade 25. The tool is squeezed in pliers fashion to bring the knife blade to bear on the conduit supported in the cradle or anvil. During cutting, the tool and conduit are rotated or swung relative to each other about the conduit axis as the knife blade is squeezed against the conduit wall. In this manner, the conduit is severed quickly, cleanly and easily by squeezing the tool handles together as the conduit is rotated. A smooth, clean, sharp cut is provided which does not damage the conduit ends, leaving them cleanly cut at right angles and suitable for the insertion of appropriate pipe fittings.

While a certain illustrative embodiment of the present invention has been shown in the drawings and described above the considerable detail, it should be understood that there is no intention to limit the invention to the specific form disclosed. On the contrary, the intention is to cover all modifications, alternative constructions, equivalents and uses falling within the spirit and scope of the invention as expressed in the appended claims.

What I claim is:

1. A cutting tool for cutting flexible plastic conduit comprising a pair of handled jaws pivotally connected intermediate their ends, one of said jaws having a handle at one end and a knife blade extending from the other end thereof opposite to said handle, said knife blade having a longitudinal cutting edge, the other of said jaws defining a channel-shaped handle at one end and a semi-circular concave anvil at the other end, said anvil having an axially extending slot therein for receiving the cutting edge of said knife blade when said handles are closed together with the said one handle nested within said channel-shaped handle, whereby a conduit supported in said semi-circular anvil can be cut readily by said knife blade upon squeezing said handles together while swinging said tool relative to said conduit and said conduit being completely severed as said knife blade edge is received in said slot.

2. A cutting tool for cutting flexible plastic conduit comprising a pair of handled jaws pivotally connected intermediate their ends, one of said jaws being generally box shaped in cross-section and having a handle at one end and a knife blade extending from the other end thereof opposite to said handle, said knife blade having a longitudinal cutting edge, the other of said jaws being generally channel shaped in cross-section and defining a handle at one end and a semi-circular concave anvil at the other end, said anvil having an axially extending slot therein for receiving the cutting edge of said knife blade when said handles are closed together with said box-shaped handle nested within said channel-shaped handle, whereby a conduit supported in said semi-circular anvil can be cut by said knife blade upon squeezing said handles together while swinging said tool relative to said conduit and said conduit being completely severed as said knife blade edge is received in said slot.

3. A cutting tool for cutting flexible plastic conduit comprising a pair of handled jaws pivotally connected intermediate their ends, one of said jaws being generally box shaped in cross-section and having a handle at one end and a knife blade extending from the other end thereof opposite to said handle, said knife blade having a longitudinal cutting edge, the other of said jaws being generally channel shaped in cross-section and defining a handle at one end and a semi-circular concave anvil at the other end, said anvil having an axially extending slot therein for receiving the cutting edge of said knife blade when the handles are closed together with said box-shaped handle nested within said channel-shaped handle, reinforcing ribs within the anvil section of said channel on each side of said knife receiving slot for stiffening said anvil section adjacent thereto, and said slot having an enlarged opening at the end thereof opposite the corresponding handle to accommodate flexing of said knife blade, whereby a conduit supported in said semi-circular anvil can be cut by said knife blade upon squeezing said handles together while swinging said tool relative to said conduit and said conduit being completely severed as said knife blade edge is received in said slot.

4. A cutting tool for cutting flexible plastic conduit comprising a pair of handled jaws pivotally connected intermediate their ends, one of said jaws being generally box shaped in cross-section and having a handle at one end and a knife blade removably mounted thereon and extending from the other end thereof opposite to said handle, said knife blade having a longitudinal, sharpened cutting edge, the other of said jaws being generally channel-shaped in cross-section and defining a handle at one end and a semi-circular concave anvil at the other end, said jaw having an aperture therein for receiving the knife end of said one jaw when said jaws are pivoted together, said anvil having an axially extending slot therein for receiving the cutting edge of the knife blade when said handles are closed together with said box-shaped handle nested within said channel-shaped handle, reinforcing ribs within the anvil section of said channel on each side of said knife receiving slot for stiffening the anvil section adjacent thereto, and said slot having an enlarged opening at the end thereof opposite the corresponding handle to accommodate flexing of said knife blade, whereby a conduit supported in said semi-circular anvil can be cut by said knife blade upon squeezing said handles together while swinging said tool relative to said conduit and said conduit being completely severed as said knife blade edge is received in said slot.

5. A cutting tool for cutting flexible plastic conduit comprising a pair of handled jaws pivotally connected intermediate their ends, one of said jaws being generally box-shaped in cross-section and having a handle at one end and a knife blade removably mounted thereon and extending from the other end thereof opposite to said handle, said knife blade having a longitudinal, sharpened cutting edge, said box-shaped handle comprising a generally channel-shaped member having a top panel and depending side walls, a plurality of slotted webs joining said walls and top panel, and a cover plate spanning said walls in spaced relationship to said top panel to form an enclosed box structure, said cover plate having a plurality of pins engageable with said slotted webs to secure said cover plate to said channel member, the other of said jaws being generally channel-shaped in cross-section and defining a handle at one end and a semi-circular concave anvil at the other end, said jaw having an aperture therein for receiving the knife end of said one jaw when said jaws are pivoted together, said anvil having an axially extending slot therein for receiving the cutting edge of the knife blade when said handles are closed together with said box-shaped handle nested within said channel-shaped handle, reinforcing ribs within the anvil section of said channel on each side of said knife receiving slot for stiffening the anvil section adjacent thereto, and said slot having an enlarged opening at the end thereof opposite the corresponding handle to accommodate flexing of said knife blade, whereby a conduit supported in said semi-circular anvil can be cut by said knife blade upon squeezing said handles together while swinging said tool relative to said conduit and said conduit being completely severed as said knife blade edge is received in said slot.

6. A cutting tool for cutting flexible plastic conduit comprising a pair of handled jaws pivotally connected intermediate their ends, one of said jaws being generally box-shaped in cross-section and having a handle at one end and knife blade removably mounted thereon and extending from the other end thereof opposite to said handle, said knife blade having a longitudinal, sharpened cutting edge, said box-shaped handle comprising a generally channel-shaped member having a top panel and depending side walls, a plurality of slotted webs joining said walls and top panel, a pair of spaced internal panels intermediate and parallel with said depending side walls adjacent the knife end of said handle and defining with each other a knife blade supporting slot and defining with said side walls a pair of elongated sockets, and a cover plate spanning said walls in spaced relationship to said top panel to form an enclosed box structure, said cover plate having a plurality of pins engageable with said slotted webs to secure said cover plate to said channel and having a pair of spaced ribs adapted to be snugly received within said elongated sockets, the other of said jaws being generally channel-shaped in cross-section and defining a handle at one end and a semi-circular concave anvil at the other end, said jaw having an aperture therein for receiving the knife end of said one jaw when said jaws are pivoted together, said anvil having an axially extending slot therein for receiving the cutting edge of the knife blade when said handles are closed together with said box-shaped handle nested within said channel-shaped handle, reinforcing ribs within the anvil section of said channel on each side of said knife receiving slot for stiffening the anvil section adjacent thereto, and said slot having an enlarged opening at the end thereof opposite the corresponding handle to accommodate flexing of said knife blade, whereby a conduit supported in said semi-circular anvil can be cut by said knife blade upon squeezing said handles together while swinging said tool relative to said conduit and said conduit being completely severed as said knife blade edge is received in said slot.

7. A cutting tool for cutting flexible plastic conduit comprising a pair of handled jaws pivotally connected intermediate their ends, one of said jaws having a handle at one end and a knife blade extending from the other end thereof opposite to said handle, said knife blade having a longitudinal cutting edge, the other of said jaws defining a handle at one end and a semi-circular concave anvil at the other end, said anvil having an axially extending slot therein for receiving the cutting edge of the knife blade when the handles are closed together, said slot having an enlarged opening at the end thereof opposite the corresponding handle to accommodate flexing of the knife blade, whereby a conduit supported in said semi-circular handle can be cut by said knife blade upon squeezing said handles together while swinging said shears relative to said conduit and said conduit being completely severed as said knife blade edge is received in said slot.

* * * * *